US010519610B2

(12) United States Patent
Ciloglu et al.

(10) Patent No.: US 10,519,610 B2
(45) Date of Patent: Dec. 31, 2019

(54) APPARATUS AND METHOD FOR RAIL HEAD IMPROVEMENT

(71) Applicant: L. B. Foster Company, Pittsburgh, PA (US)

(72) Inventors: Korhan Ciloglu, Pittsburgh, PA (US); William Mohr, Columbus, OH (US); David Workman, Columbus, OH (US)

(73) Assignee: L.B. Foster Company, Pittsburgh, PA (US)

( * ) Notice: Subject to any disclaimer, the term of this patent is extended or adjusted under 35 U.S.C. 154(b) by 157 days.

(21) Appl. No.: 15/690,002

(22) Filed: Aug. 29, 2017

(65) Prior Publication Data

US 2018/0127925 A1 May 10, 2018

Related U.S. Application Data

(60) Provisional application No. 62/380,940, filed on Aug. 29, 2016.

(51) Int. Cl.
*E01B 11/56* (2006.01)
*E01B 11/44* (2006.01)

(52) U.S. Cl.
CPC ..... *E01B 11/56* (2013.01); *E01B 11/44* (2013.01)

(58) Field of Classification Search
CPC ..... E01B 11/56; E01B 5/08; E01B 11/44
See application file for complete search history.

(56) References Cited

U.S. PATENT DOCUMENTS 1,814,476 A * 7/1931 Kurz ..... E01B 5/10 238/148
1,856,911 A * 5/1932 Faries ..... E01B 5/08 238/143

FOREIGN PATENT DOCUMENTS

DE 20 64 344 Al 8/1972
DE 2064344 A1 * 8/1972 ..... E01B 5/08
EP 0 601 420 B1 9/1996

OTHER PUBLICATIONS

Form PCT/ISA/220, PCT Notification of Transmittal of the International Search Report and the Written Opinion of the International Searching Authority, or the Declaration, PCT/US2017/049182, dated Dec. 7, 2017.
Form PCT/ISA/210, PCT International Search Report for International Application No. PCT/US2017/049182, dated Dec. 7, 2017.
Form PCT/ISA/237, PCT Written Opinion of the International Searching Authority for International Application No. PCT/US2017/049182, dated Dec. 7, 2017.

* cited by examiner

*Primary Examiner* — Jason C Smith
(74) *Attorney, Agent, or Firm* — Paul D. Bangor, Jr.; Clark Hill, PLC

(57) ABSTRACT

A railroad rail comprising a rail head, wherein the rail head is made from a first material and defines a void, and an insert comprising a second material installed in the void.

4 Claims, 2 Drawing Sheets

APPARATUS AND METHOD FOR RAIL HEAD IMPROVEMENT

This application claims the benefit of provisional patent application U.S. Ser. No. 62/380,940 filed Aug. 29, 2016, which is incorporated by reference herein for all purposes.

FIELD OF THE DISCLOSURE

This invention is related to a rail heads of railroad rails and particularly related to the ends thereof forming parts of a rail joint.

BACKGROUND OF THE DISCLOSURE

Rail joints create impacts due to discontinuity between two rails. The impacts cause damage to the rails. The detrimental effects of such impacts caused by discontinuity of the running surface of the rail are particularly visible in insulated rail joints (see FIGS. 1 and 2) and special trackwork elements. The focus of this invention is to improve the rails in insulated rail joint, standard rail joints and special trackwork applications. The apparatus and method of the present disclosure is well-suited for insulated rail joints, and also for other areas of rail infrastructure such as standard joints and special trackwork.

BRIEF SUMMARY OF THE DISCLOSURE

Many other variations are possible with the present disclosure, and those and other teachings, variations, and advantages of the present disclosure will become apparent from the description and figures of the disclosure.

One aspect of a preferred embodiment of the present disclosure comprises a railroad rail comprising a rail head, wherein the rail head is made from a first material and defines a void, and an insert comprising a second material installed in the void.

In another aspect of a preferred railroad rail of the present disclosure, the first material is rail steel.

In yet another aspect of a preferred railroad rail of the present disclosure, the second material is selected from a group consisting of tool steel, heat treated tool steel, A9 tool steel, heat treated A9 tool steel or A9 tool steel heat treated to achieve 49 Rc hardness (equivalent to 462 BHN, compared to 380 BHN of rail steel).

In an additional aspect of a preferred railroad rail of the present disclosure, the insert defines a tongue that is received in a groove comprising part of the void.

In another aspect of a preferred railroad rail of the present disclosure, the insert defines a protrusion that is received in an opening, hollow or slot comprising part of the void.

In yet another aspect of a preferred railroad rail of the present disclosure, each of the insert and the void defines one or more geometrical features preventing or restricting movement of the insert within the void.

In a further aspect of a preferred railroad rail of the present disclosure, each of the one or more geometrical features of the insert is complementary to one of the geometrical features of the void.

In another aspect of a preferred railroad rail of the present disclosure, the insert is installed in the void by one or more of friction-fitting, force-fitting, slide-fitting, adhesive bonding or brazing.

Another aspect of a preferred embodiment of the present disclosure comprises a method for installing an insert in a rail head comprising: wrapping the insert in-whole or in-part with a brazing material; inserting the wrapped insert into a void in the rail head, and heating the wrapped insert and surrounding rail head to braze the insert to the rail head.

In another aspect, a preferred a method for installing an insert in a rail head of the present disclosure further comprises feeding brazing material into the joints between the insert and the void during heating to compensate for brazing material flowing out of the void during heating.

In yet another aspect of a preferred a method for installing an insert in a rail head of the present disclosure, the brazing material comprises BAg-7.

In another aspect of a preferred a method for installing an insert in a rail head of the present disclosure, the heating is performed at 1,200° F.

Yet another aspect of a preferred embodiment of the present disclosure comprises a rail joint assembly comprising two railroad rail ends, wherein one of the railroad rail ends comprises a rail head, wherein the rail head is made from a first material and defines a void, and an insert comprising a second material installed in the void.

In another aspect of a preferred rail joint assembly of the present disclosure, both of the railroad rail ends comprises a rail head made from a first material defining a void and an insert comprising a second material installed in the void.

In yet another aspect of a preferred rail joint assembly of the present disclosure, the first material is rail steel and the second material is selected from a group consisting of tool steel, heat treated tool steel, A9 tool steel, heat treated A9 tool steel or A9 tool steel heat treated to achieve 49 Rc hardness (equivalent to 462 BHN, compared to 380 BHN of rail steel).

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION

In the following detailed description, reference is made to the accompanying examples and figures that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "disclosure" merely for convenience and without intending to voluntarily limit the scope of this application to any single disclosure or inventive concept if more than one is in fact disclosed.

The following description is, therefore, not to be taken in a limited sense, and the scope of this disclosure is defined by the appended claims.

Insulated rail joints are commonly used for signaling control and broken rail detection in signaled track. The rails used in rail joints are made of regular rails, compliant with railroad standards. The rails are drilled, cut and assembled per railroad industry standards and standards proprietary to the insulated rail joint suppliers. The design options for a rail joint can include various bar designs, assembly process, unique parts used in the joint assembly or unique cutting geometries. While there may be many design options for an insulated rail joint and its parts, these design options do not generally include major alterations to the rails used in the joint other than fabricating the rails in a specific shape or form.

Historically, the only alteration that has been made to virgin rails used in a joint application is rail end hardening, which is a heat treatment process to harden the ends of the rails for improved performance in the field. This method doesn't involve any replacement of rail material with another material. The method was embraced in the past, however the industry and suppliers gradually moved away from it mainly due to improvements in premium rail qualities supplied by the rail mills.

Figure 1:
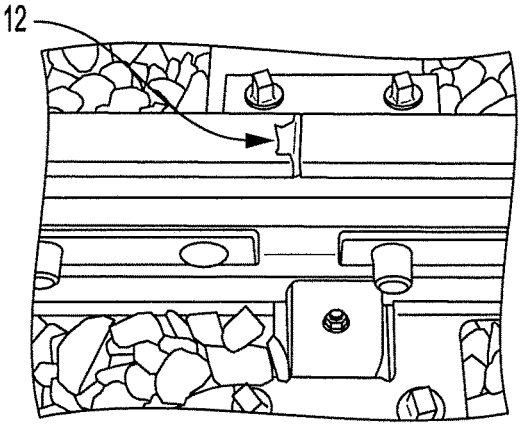
FIG. 1 shows rail end batter damage in conventional rail heads.
Figure 2:
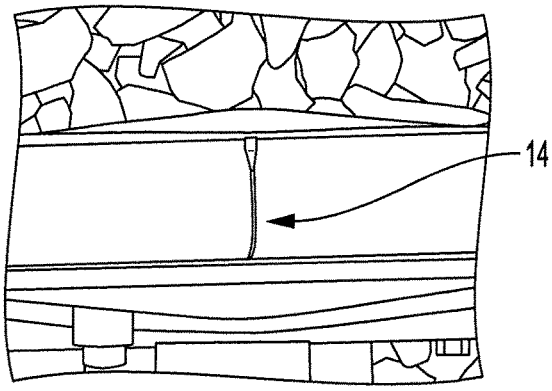
FIG. 2 shows plastic flow damage in conventional rail heads.

Rail end damage within insulated rail joints is widely known (see FIGS. 1 and 2). While the performance of rail joints in their operational environment has increased as a result of improved designs and track maintenance, rail end damage still remains one of the key initiators of failure in rail joints (ref: RT&S magazine, August 2016 edition, incorporated herein by reference).

Figure 3:
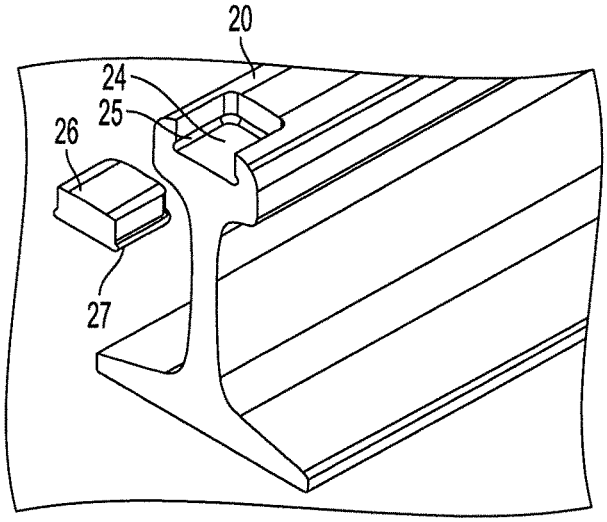
FIG. 3 is an exploded top perspective view of a rail head defining a void or cut-out section that receives an insert in accordance with the present disclosure.
Figure 4:
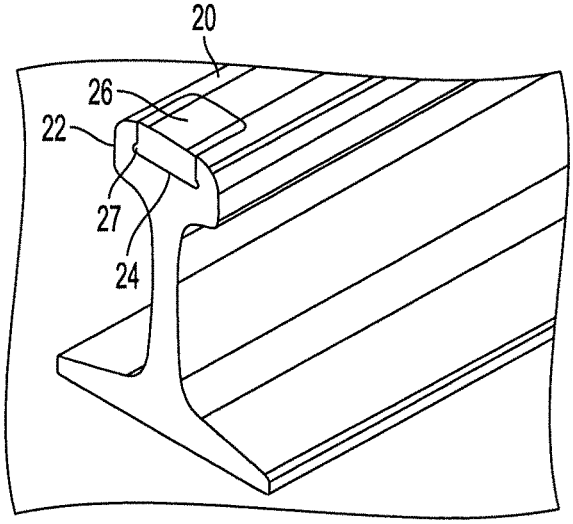
FIG. 4 is a top perspective view of a rail head having an insert disposed within a void or cut-out section in accordance with the present disclosure.
Figure 6:
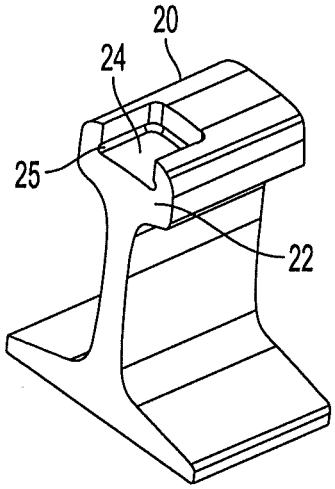
FIG. 6 is a top perspective view of a rail head defining a void or cut-out section for receiving an insert in accordance with the present disclosure.
Figure 7:
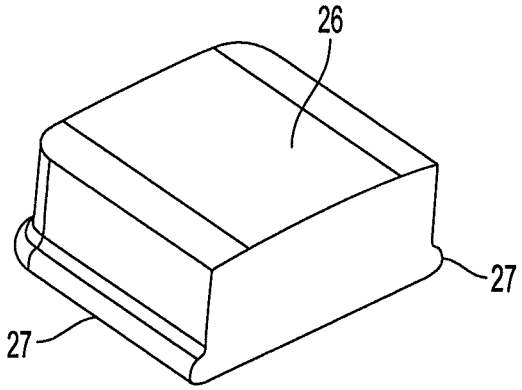
FIG. 7 is a top perspective view of an insert for installation in a rail head defining a void or cut-out section in accordance with the present disclosure.
Figure 8:
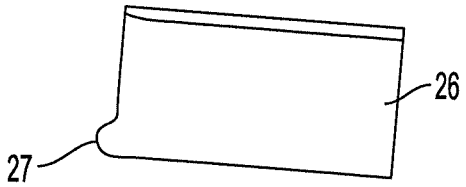
FIG. 8 is a left side view of an insert for installation in a rail head defining a void or cut-out section in accordance with the present disclosure.
Figure 9:
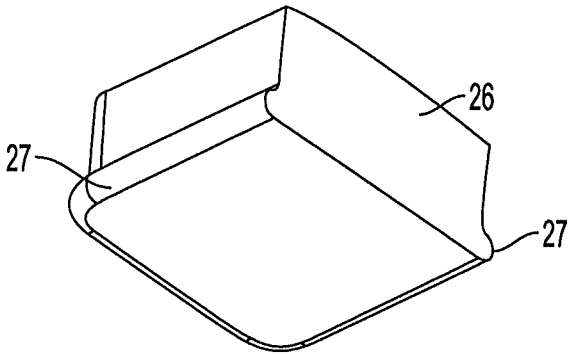
FIG. 9 is a bottom perspective view of an insert for installation in a rail head defining a void or cut-out section in accordance with the present disclosure.

The apparatus and method of the present disclosure comprises a rail head end 22 of rail head 20 defining a void 24 (FIGS. 3 and 6) having a particular geometry and an insert or tip 26 (FIGS. 3, 4 and 7) made of an improved material installed in the void 24 (see FIG. 3 and FIG. 4).

A preferred embodiment of the present disclosure shows a particular shape for void 24, which may be customized as required, and a complementary shape for insert 26 to be inserted in the void 24. Preferably, insert 26 is fixed in void 24 by one or more of friction-fitting, force-fitting, slide-fitting, adhesive bonding and/or brazing.

Void 24 and insert 26 define geometric locking features such as tongue 27 disposed around one or more of the three sides of insert 26 that are inserted into void 24. Tongues 27 are received in grooves 25 that form part of void 24. Such locking features may be shaped as necessary to assist in enabling insert 26 to remain in its place within void 24 in the event of a bond failure between insert 26 and rail head 20.

Insert 26 is preferably made from heat treated tool steel, such as A9 tool steel, possessing superior properties compared to rail steel.

In a preferred method of the present disclosure for installing insert 26 in void 24, insert 26 is wrapped with BAg-7 brazing foil and inserted into void 24. The assembly is heated up to 1,200° F., preferably using torch heaters. In addition, a feeder tube of BAg-7 brazing material is held above the vertical cut lines of the brazed joint between insert 26 and void 24 to back fill BAg-7 brazing material as some of the BAg-7 brazing material from the wrapping will inevitably flow out of the joint during the brazing process. After the joint is fully brazed, the heat is removed and the brazed joint comprising insert 26 in void 24 preferably cools down in the ambient plant environment. Following the cool down, excess brazed material is cleaned away to bring rail head end 22 back to its original and acceptable shape.

Figure 5:
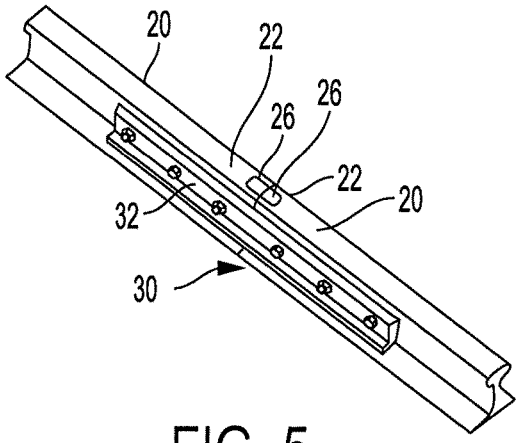
FIG. 5 is a top perspective view of a rail joint comprising rail heads having an insert disposed within a void or cut-out section in accordance with the present disclosure.

Preferably, rails with modified rail heads according to the present disclosure having the insert 26 brazed in void 24 construction are assembled with bars and other design elements in the discontinuous portion 30 (generally the middle of the rail joint) of a standard rail joint assembly as shown in FIG. 5.

It will be readily understood to those skilled in the art that various other changes in the details, components, material, and arrangements of the parts and methods which have been described and illustrated in order to explain the nature of this disclosure may be made without departing from the principles and scope of the disclosure as expressed in the subjoined claims.

In the foregoing description of preferred embodiments of the present disclosure, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the foregoing description, with each claim standing on its own as a separate embodiment.

What is claimed is:

1. A method for installing an insert in a rail head comprising: wrapping the insert in-whole or in-part with a brazing material; inserting the wrapped insert into a void in the rail head, and heating the wrapped insert and surrounding rail head to braze the insert to the rail head.

2. The method of claim 1 further comprising feeding brazing material into the joints between the insert and the void during heating to compensate for brazing material flowing out of the void during heating.

3. The method of claim 1 wherein the brazing material comprises BAg-7.

4. The method of claim 1 wherein the heating is performed at 1,200° F.

* * * * *